US011288989B2

(12) United States Patent
Tsai et al.

(10) Patent No.: US 11,288,989 B2
(45) Date of Patent: Mar. 29, 2022

(54) SOURCE DRIVER FOR DRIVING AND SENSING DISPLAY PANEL AND CALIBRATION METHOD THEREOF

(71) Applicant: Novatek Microelectronics Corp., Hsinchu (TW)

(72) Inventors: Yi-Yang Tsai, Hsinchu County (TW); Po-Hsiang Fang, Hsinchu (TW); Jhih-Siou Cheng, New Taipei (TW); Ju-Lin Huang, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/867,483

(22) Filed: May 5, 2020

(65) Prior Publication Data

US 2021/0350731 A1 Nov. 11, 2021

(51) Int. Cl.
*G09G 3/00* (2006.01)
*G09G 3/3291* (2016.01)

(52) U.S. Cl.
CPC ..... *G09G 3/006* (2013.01); *G09G 3/3291* (2013.01); *G09G 2310/0291* (2013.01); *G09G 2310/0294* (2013.01); *G09G 2320/045* (2013.01); *G09G 2320/0693* (2013.01); *G09G 2330/12* (2013.01)

(58) Field of Classification Search
CPC ..... G09G 3/006; G09G 3/3291; G09G 2310/0291; G09G 2310/0294; G09G 2320/045; G09G 2320/0693; G09G 2330/12
See application file for complete search history.

(56) References Cited

U.S. PATENT DOCUMENTS

| | | | |
|---|---|---|---|
| 7,859,501 | B2 | 12/2010 | Levey et al. |
| 9,761,177 | B2 | 9/2017 | Mizukoshi |
| 9,905,160 | B2 | 2/2018 | Woo et al. |
| 10,013,920 | B2 | 7/2018 | Oh et al. |

(Continued)

FOREIGN PATENT DOCUMENTS

| | | |
|---|---|---|
| CN | 104732920 | 5/2017 |
| CN | 105427796 | 4/2018 |

(Continued)

OTHER PUBLICATIONS

"Office Action of Taiwan Counterpart Application", dated Dec. 10, 2020, pp. 1-8.

*Primary Examiner* — Lisa S Landis
(74) *Attorney, Agent, or Firm* — JCIPRNET

(57) ABSTRACT

A source driver and a calibration method thereof are provided. The source driver for driving and sensing a display panel of the disclosure includes a sensing circuit, an analog-to-digital converter circuit and a digital arithmetic circuit. The sensing circuit is configured to receive a reference signal through a sensing channel when the source driver is operated in a calibration mode. The analog-to-digital converter circuit is coupled to the sensing circuit, and configured to convert the reference signal to a digital reference signal. The digital arithmetic circuit is coupled to the analog-to-digital converter circuit, and configured to obtain a calibration parameter according to the digital reference signal. The source driver calibrates a sensing path for sensing a display panel according to the calibration parameter when the source driver is operated in a sensing mode.

18 Claims, 4 Drawing Sheets

(56) References Cited

U.S. PATENT DOCUMENTS

| | | | | |
|---|---|---|---|---|
| 2008/0315788 | A1* | 12/2008 | Levey | G09G 3/3233 315/291 |
| 2015/0179105 | A1 | 6/2015 | Mizukoshi | |
| 2016/0078805 | A1 | 3/2016 | Woo et al. | |
| 2017/0193881 | A1* | 7/2017 | Kim | G09G 3/2074 |
| 2017/0345377 | A1 | 11/2017 | Oh et al. | |

FOREIGN PATENT DOCUMENTS

| | | |
|---|---|---|
| CN | 111179833 | 5/2020 |
| CN | 111292680 | 6/2020 |
| TW | I374423 | 10/2012 |
| TW | I600323 | 9/2017 |

* cited by examiner

SOURCE DRIVER FOR DRIVING AND SENSING DISPLAY PANEL AND CALIBRATION METHOD THEREOF

BACKGROUND

Technical Field

The disclosure relates to a driver circuit, and particularly relates to a source driver and a calibration method thereof.

Description of Related Art

In general, the basic architecture of the organic light emitting diode (OLED) display system is that timing controller (TCON) passes RGB data to source driver, and the corresponding voltage is output through the digital-to-analog converter (DAC) and the operational amplifier (OP) of the source driver. It is should be noted that the OLED display system has a loop that needs to compensate for the degradation of pixel unit of the OLED. Thus, the general source driver has a sensing channel and an analog-to-digital converter (ADC) to detect the degradation of the OLED. However, due to the influence of process and temperature changes on the source driver integrated circuit (IC), the Source IC itself may have differences between the IC and the another IC or the IC itself. In this regard, the OLED display system has to transmit internal information (such as state machine status, bit error, lock status) through additional interfaces (such as LVDS, I2C or custom protocols). In other words, in order to access a large amount of information inside the panel and the Source IC to calibrate the characteristics of the Source IC and perform degradation compensation in the OLED system, the TCON needs to use a large amount of algorithm, memory hardware space and data transmission time. Therefore, regarding how to reduce the amount of data transmission between the source drive and the TCON, and reduce the large amount of algorithm in the timing controller, memory hardware space and compensation time, solutions of several embodiments are provided below.

SUMMARY

The disclosure is directed to a source driver and a calibration method thereof, and are capable of dynamically self-calibrating a sensing path for sensing a display panel.

The source driver for driving and sensing a display panel of the disclosure includes a sensing circuit, an analog-to-digital converter circuit and a digital arithmetic circuit. The sensing circuit is configured to receive a reference signal through a sensing channel when the source driver is operated in a calibration mode. The analog-to-digital converter circuit is coupled to the sensing circuit, and configured to convert the reference signal to a digital reference signal. The digital arithmetic circuit is coupled to the analog-to-digital converter circuit, and configured to obtain a calibration parameter according to the digital reference signal. The source driver calibrates a sensing path for sensing a display panel according to the calibration parameter when the source driver is operated in a sensing mode.

The calibration method of the disclosure is adapted to a source driver for driving and sensing a display panel. The calibration method includes following steps. A reference signal is received by a sensing circuit through a sensing channel when the source driver is operated in a calibration mode. The reference signal is converted by an analog-to-digital converter circuit to a digital reference signal. A calibration parameter is obtained by a digital arithmetic circuit according to the digital reference signal. A sensing path for sensing the display panel is calibrated by the source driver according to the calibration parameter when the source driver is operated in a sensing mode.

Based on the above, according to the source driver and the calibration method thereof of the disclosure, the source driver is capable of obtaining the calibration parameter for the sensing path when the source driver is operated in the calibration mode, and source driver is capable of self-calibrating the sensing path according to the calibration parameter when the source driver is operated in the sensing mode. Therefore, the source driver of the disclosure can accurately sense, for example, degradation of the pixel unit of display panel.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

It is to be understood that other embodiments may be utilized and structural changes may be made without departing from the scope of the disclosure. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Figure 1:
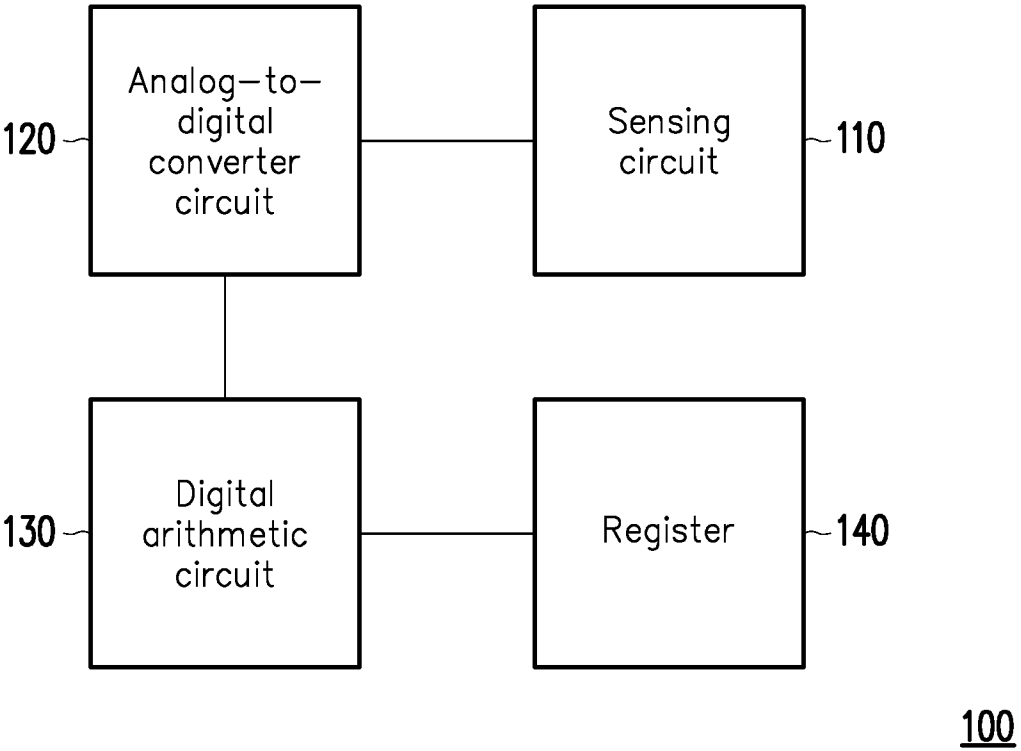
FIG. 1 is a schematic diagram illustrating a source driver according to an embodiment of the disclosure.

FIG. 1 is a schematic diagram illustrating a source driver according to an embodiment of the disclosure. Referring to FIG. 1, a source driver 100 includes a sensing circuit 110, an analog-to-digital converter circuit 120, a digital arithmetic circuit 130 and a register 140. The sensing circuit 110 is coupled to the analog-to-digital converter circuit 120. The analog-to-digital converter circuit 120 is coupled to the digital arithmetic circuit 130. The digital arithmetic circuit 130 is coupled to the register 140. In the embodiment of the disclosure, the source driver 100 is configured to drive and sense a display panel, such as an organic light emitting diode (OLED) display panel. The sensing circuit 110 further includes a sensing channel. The sensing channel is coupled to a pixel unit of the display panel, and sensing circuit 110 is configured to receive a sensing signal from the pixel unit of the display panel through the sensing channel when the source driver 100 is operated in a sensing mode.

Specifically, in the embodiment of the disclosure, the source driver 100 may sense the display panel through a sensing path in the source driver 100, but the sensing path may have some non-ideal effects, thereby causing the deviation in the sensing result of the display panel. In the embodiment of the disclosure, the sensing path is a path between the sensing circuit 110 and the analog-to-digital converter circuit 120. Therefore, in order to calibrate the deviation in the sensing result of the display panel, before the source driver 100 is operated in the sensing mode, the source driver 100 may be operated in a calibration mode (self-calibration).

In the embodiment of the disclosure, the sensing circuit 110 receives a reference signal through the sensing channel when the source driver 100 is operated in the calibration mode. The analog-to-digital converter circuit 120 converts the reference signal to a digital reference signal, and then the digital arithmetic circuit 130 obtains a calibration parameter according to the at least one digital reference signal. In one embodiment of the disclosure, the register 140 may store the calibration parameter. Therefore, the source driver 100 can calibrate the sensing path according to the calibration parameter when the source driver 100 is operated in the sensing mode. Moreover, in one embodiment of the disclosure, the reference signal may be a fixed voltage from a voltage source, but the disclosure is not limited thereto. In other words, the source driver 100 of the embodiment of the disclosure is capable of self-calibrating the sensing path in the source driver 100 to accurately sense the pixel unit of the display.

Figure 2:
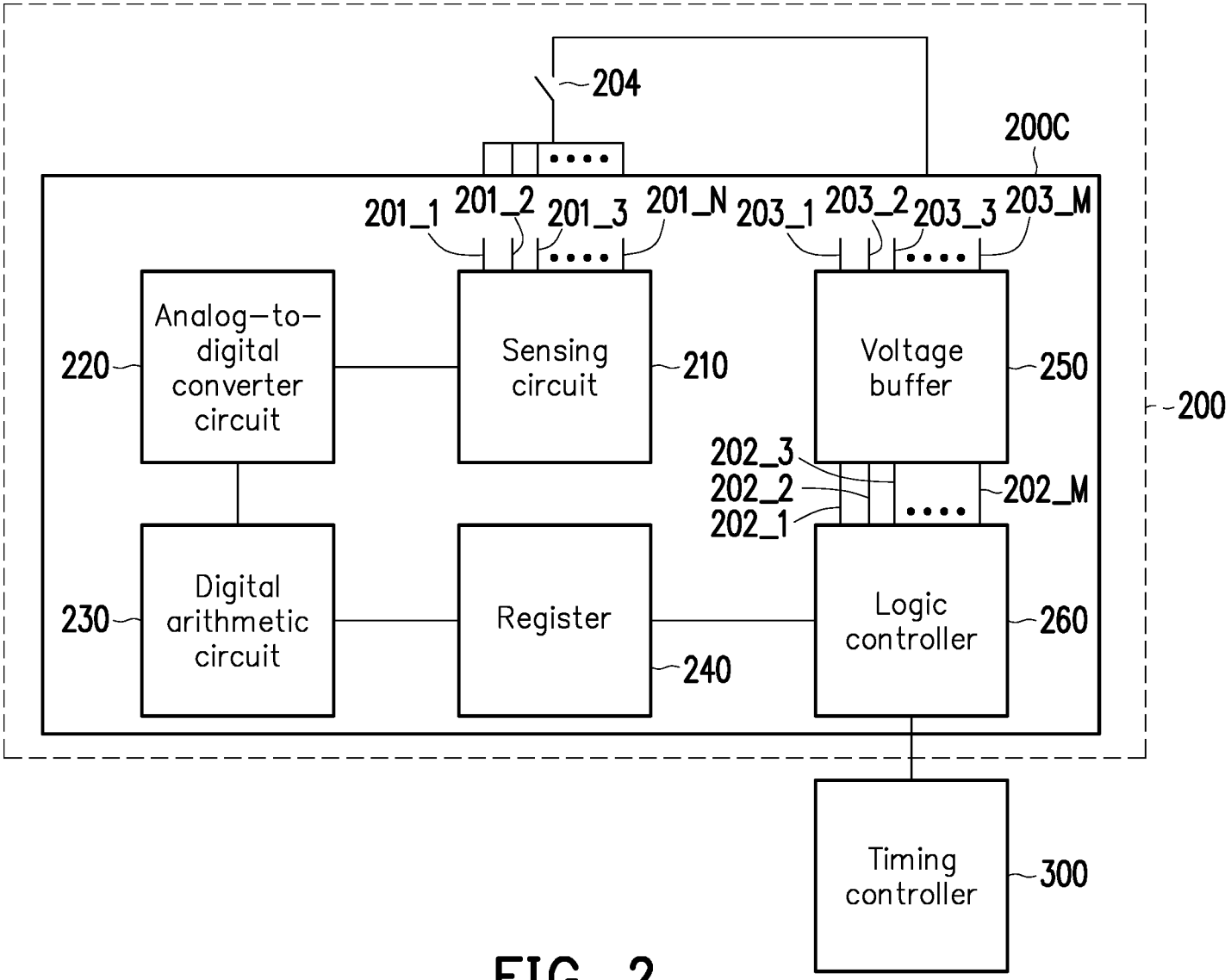
FIG. 2 is a schematic diagram illustrating a source driver according to another embodiment of the disclosure.

FIG. 2 is a schematic diagram illustrating a source driver according to another embodiment of the disclosure. Referring to FIG. 2, a source driver 200 includes a sensing circuit 210, an analog-to-digital converter circuit 220, a digital arithmetic circuit 230, a register 240 and a driving circuit. In the embodiment of the disclosure, the sensing circuit 210, the analog-to-digital converter circuit 220, the digital arithmetic circuit 230, the register 240 and the driving circuit are integrated to a digital integrated circuit (DIC) 200C. The sensing circuit 210 is coupled to the analog-to-digital converter circuit 220. The analog-to-digital converter circuit 220 is coupled to the digital arithmetic circuit 230. The digital arithmetic circuit 230 is coupled to the register 240. The register 240 is coupled to the logic controller 260. In the embodiment of the disclosure, the sensing circuit 210 includes a plurality of sensing channels 201_1-201_N coupled to a plurality of pixel units of a display panel, where N is a positive integer greater than 1. The driving circuit includes a plurality of driving channels 203_1~203_M coupled to the pixel units of a display panel, where M is a positive integer greater than 1.

In the embodiment of the disclosure, the driving circuit includes a voltage buffer 250 and a logic controller 260. The voltage buffer 250 is coupled to the driving channels 203_1~203_M. The voltage buffer 250 may include a plurality of buffer units, therefore the logic controller 260 is coupled to the voltage buffer 250 through a plurality of signal transmission channels 202_1~202_M and further coupled to a timing controller (TCON) 300 through, for example, an inter integrated circuit (I2C) interface or a low voltage differential signaling (LVDS) interface. When the source driver 200 is operated in a driving mode, the logic controller 260 receives a driving voltage data from the timing controller 300, and outputs a plurality of driving signals to the voltage buffer 250 through the signal transmission channels 202_1~202_M, so that the voltage buffer 250 outputs the driving signals to display panel to drive the pixel units of the display panel through the driving channels 203_1~203_M. In addition, when the source driver 200 is operated in a normal calibration mode, the sensing circuit 210 may receive the panel information from the sensing channels 201_1~201_N, and provide or pre-store the panel information to the register 240 through the analog-to-digital converter circuit 220 and the digital arithmetic circuit 230. Then, the register 240 further provide the panel information to the logic controller 260, and the logic controller 260 outputs the panel information to the timing controller 300.

In the embodiment of the disclosure, the sensing circuit 210 is configured to receive a plurality of sensing signals from the pixel units of the display panel through the sensing channels 201_1~201_N when the source driver 200 is operated in a sensing mode, and the analog-to-digital converter circuit 220 and the digital arithmetic circuit 230 are configured to generate a plurality of digital coeds corresponding to the sensing signals, so that the digital arithmetic circuit 230 may further provide the digital coeds to the timing controller 300 for performing the related compensation-driven operations, such as adjusting the driving signals. It is should be noted that, when the source driver 200 senses the display panel through the sensing channels 201_1~201_N and the sensing circuit 210, the sensing channels 201_1~201_N and the sensing circuit 210 may exist some non-ideal effects, thereby causing the deviation in the sensing result of the display panel. Thus, the source driver 200 has to calibrate the sensing channels 201_1~201_N and the sensing circuit 210. In other words, in order to calibrate the deviation in the sensing result of the display panel, before the source driver 200 is operated in the sensing mode, the source driver 200 may be operated in a calibration mode.

In the embodiment of the disclosure, the sensing channels 201_1~201_N may be further coupled to the driving channels 203_1~203_M. As shown in FIG. 2, the driving channels 203_1~203_M may be coupled to a first terminal of a switch circuit 204 through one trace disposed outside the digital integrated circuit 200C, the sensing channels 201_1~201_N may be coupled to a second terminal of the switch circuit 204 through another plurality of traces disposed outside the digital integrated circuit 200C. Specifically, when the source driver 200 is operated in the calibration mode, the source driver 200 controls the switch circuit 204, so that the switch circuit 204 is turned on. Then, the logic controller 252 receives the driving voltage data from the timing controller 300, and outputs at least one reference signal to the voltage buffer 251 according to the driving voltage data, so that the voltage buffer 251 outputs the at least one reference signal to the sensing channels 201_1~201_N and the sensing circuit 210 through at least one of the driving channels 203_1~203_M, where the at least one reference signal may be a fixed voltage. Thus, the analog-to-digital converter circuit 220 converts the at least one reference signal to at least one digital reference signal. The digital arithmetic circuit 230 obtains at least one calibration parameter according to the at least one digital reference signal. Therefore, the source driver 200 can calibrate the sensing path between the sensing circuit 210 and the analog-to-digital converter circuit 220 according to the at least one calibration parameter when the source driver is operated in the sensing mode. That is, the source driver 200 of the embodiment of the disclosure is capable of self-calibrating the sensing path in the source driver 200 to accurately sensing the pixel unit of the display.

Further, in one embodiment of the disclosure, the source driver 200 may store the calibration parameter into the register 240, so that the register 240 may output the pre-store calibration parameter for the source driver 200 calibrating the sensing path in sensing mode. In addition, when the source driver 200 is operated in the sensing mode or in the driving mode, the source driver 200 controls the switch circuit 204, so that the switch circuit 204 is turned off. In other words, the source driver 200 of the embodiment of the disclosure can control the switch circuit 204 to switch whether to perform the calibration mode.

Figure 3:
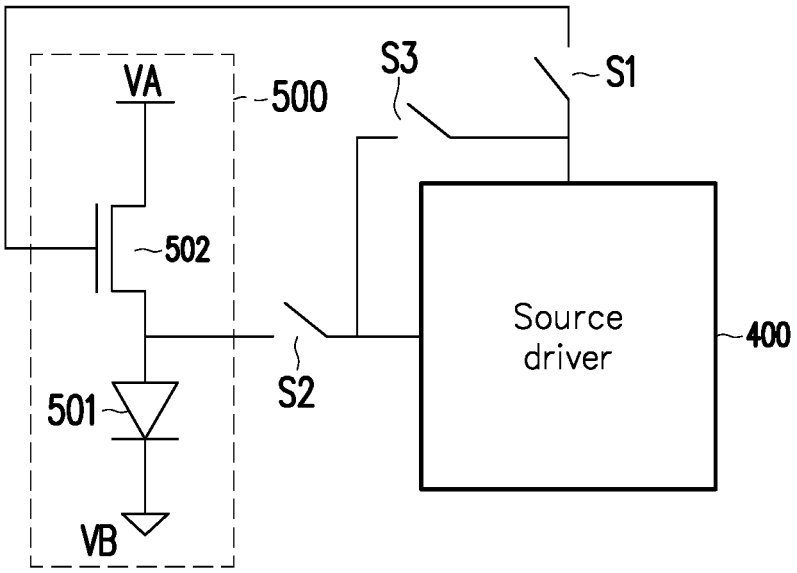
FIG. 3 is a schematic diagram illustrating a source driver coupled to a pixel unit according to an embodiment of the disclosure.
Figure 4:
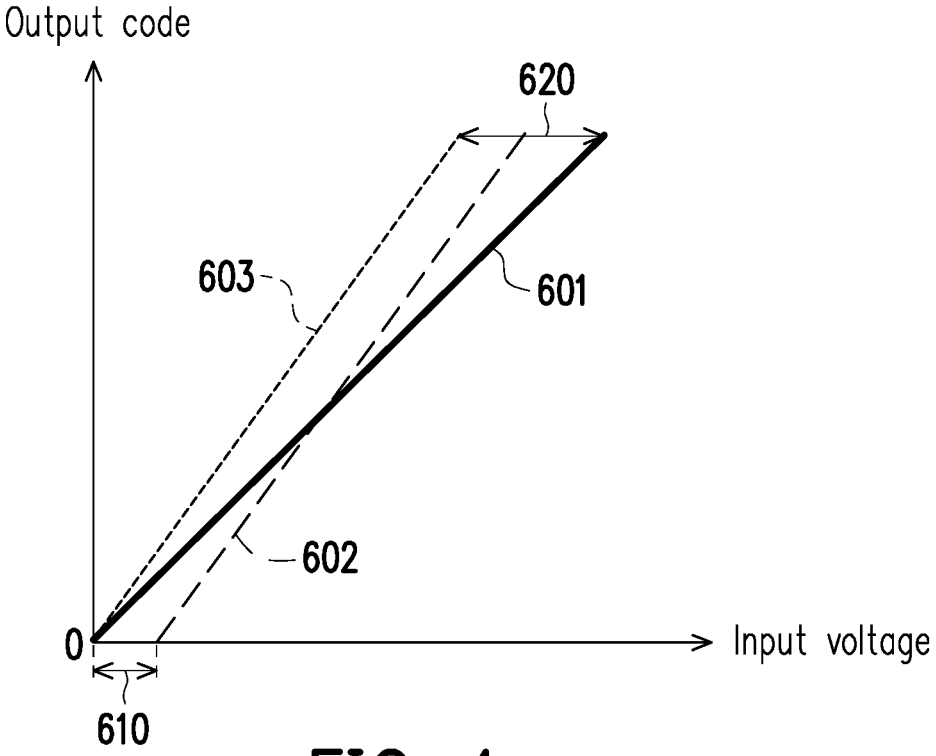
FIG. 4 is a schematic diagram illustrating a plurality of characteristic curves according to an embodiment of the disclosure.

FIG. 3 is a schematic diagram illustrating a source driver coupled to a pixel unit according to an embodiment of the disclosure. FIG. 4 is a schematic diagram illustrating a plurality of characteristic curves according to an embodiment of the disclosure. Referring to FIG. 3 and FIG. 4, the source driver 400 of the embodiment of the disclosure may include a plurality of internal circuits such as the source driver 200 of the above embodiment, and a pixel unit 500 includes an organic light-emitting diode 501 and a transistor 502. In the embodiment of the disclosure, a first terminal of the transistor 502 is coupled to a reference voltage VA, a control terminal of the transistor 502 is coupled to a driving channel of the source driver 400 through a switch S1, and a second terminal of the transistor 502 is coupled to a sensing channel of the source driver 400 and a first terminal of the organic light-emitting diode 501. A second terminal of the organic light-emitting diode 501 is coupled to a reference voltage VB. The sensing channel of the source driver 400 is coupled to the first terminal of the organic light-emitting diode 501 through a switch S2. The sensing channel of the source driver 400 is coupled to the driving channel of the source driver 400 through a switch S3. It is should be noted that, the schematic diagram of FIG. 4 includes an ideal characteristic curve 601, an actual characteristic curve 602 and a shifted characteristic curve 603 related to the sensing path of the source driver 400.

In the embodiment of the disclosure, when the source driver 400 is operated in a calibration mode, the switches S1 and S2 are turned off and the switch S3 is turned on. The driving channel of the source driver 400 may sequentially provide a plurality of input voltage (a plurality of reference signals) to the sensing channel of the source driver 400, so that the source driver 400 may obtain a plurality of output codes, where the output codes may form the actual characteristic curve 602 as shown in FIG. 4. Thus, as shown in FIG. 4, a digital arithmetic circuit of the source driver 400 may obtain an offset error 610 parameter by comparing a voltage difference between of two input voltages respectively corresponding to the minimum output codes of the ideal characteristic curve 601 and the actual characteristic curve 602. Then, the actual characteristic curve 602 is shifted according to the offset error parameter 610 to get the shifted characteristic curve 603. Thus, as shown in FIG. 4, the digital arithmetic circuit of the source driver 400 may obtains a gain error parameter 620 by comparing a voltage difference between of two input voltages respectively corresponding to the maximum output codes of the ideal characteristic curve 601 and the shifted characteristic curve 603.

In the embodiment of the disclosure, the source driver 400 can store a plurality of non-ideal parameters including the offset error parameter 610 and the gain error parameter 620, and generate a plurality of calibration parameters according to the non-ideal parameters. In the embodiment of the disclosure, when the source driver 400 is operated in a sensing mode, the switch S3 is turned off and the switches S1 and S2 are turned on. The driving channel of the source driver 400 may provide a test voltage to the transistor 502, so that the transistor 502 drives the organic light-emitting diode 501 according to the test voltage. Then, the source driver 400 may obtain a sensing voltage through the sensing channel of the source driver 400, where the sensing channel of the source driver 400 has pre-calibrated by source driver 400 according to the above calibration parameters. That is, the source driver 400 is capable of self-calibrating the sensing path in the source driver 400 to accurately sense the pixel unit 500.

Besides, in the embodiment of the disclosure, when the source driver 400 is operated in a driving mode, the switches S2 and S3 are turned off and the switch S1 is turned on. The source driver 400 may quickly compensate the driving signal, for example, by the logic controller 260 in FIG. 2, and the driving channel of the source driver 400 provides a compensated driving voltage to the transistor 502, so that the transistor 502 drives the organic light-emitting diode 501 according to the compensated driving voltage. Therefore, the source driver 400 is capable of accurately driving the pixel unit 500 by accurately compensated driving voltage to effectively overcome the degradation of pixel unit 500.

Figure 5:
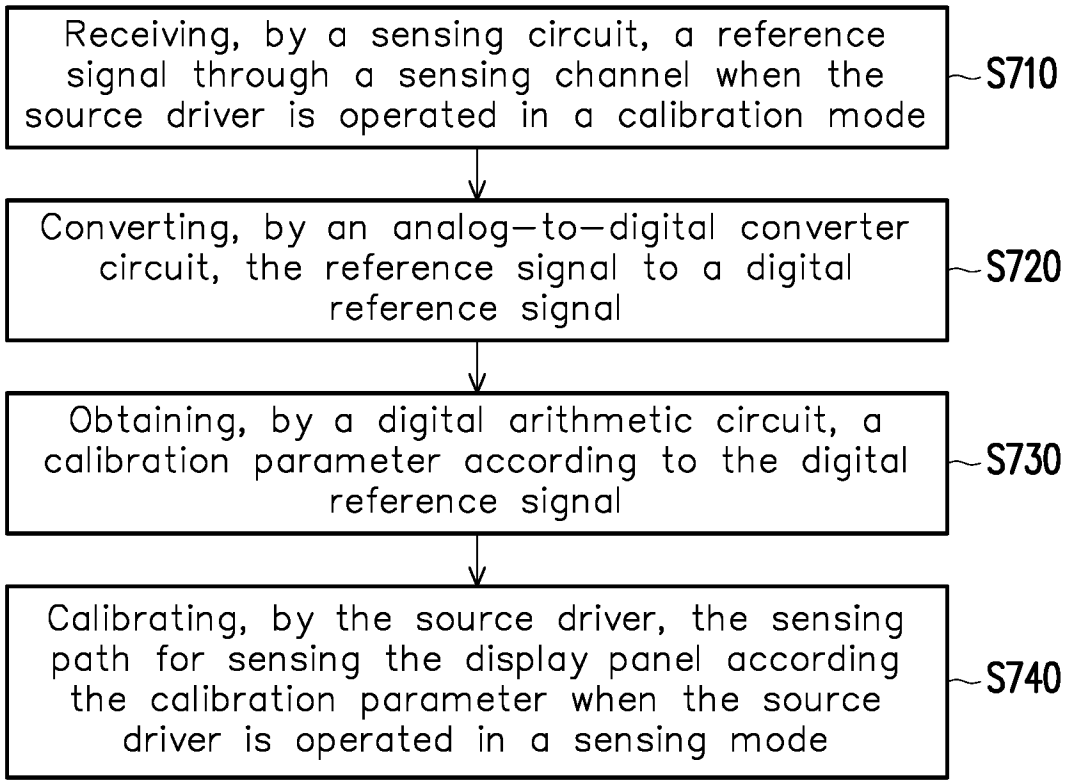
FIG. 5 is a flowing chart illustrating a calibration method according to an embodiment of the disclosure.

FIG. 5 is a flowing chart illustrating a calibration method according to an embodiment of the disclosure. Referring to FIG. 1 and FIG. 5, the calibration method may be at least adapted to the source driver 100 of FIG. 1. In step S710, the sensing circuit 110 receives a reference signal through a sensing channel when the source driver 100 is operated in a calibration mode. In step S720, the analog-to-digital converter circuit 120 converts the reference signal to a digital reference signal. In step S730, the digital arithmetic circuit 130 obtains a calibration parameter according to the digital reference signal. In step S740, the source driver 100 calibrates the sensing path for sensing the display panel according to the calibration parameter when the source driver 100 is operated in a sensing mode. Therefore, the source driver 100 is capable of actually calibrating the sensing path according to the calibration parameter. In addition, enough teachings and recommendations for related internal circuits of the source driver 100, implementation details and technical features of the source driver 100 of the embodiment may be learned from related descriptions of the embodiments of FIG. 1 to FIG. 4, and details thereof are not repeated.

In summary, according to the source driver and the calibration method thereof of the disclosure, the source driver is capable of performing self-calibration to obtain the calibration parameter for the sensing path and calibrating the sensing path according to the calibration parameter. Moreover, the source driver is further capable of accurately driving the pixel unit by accurately compensated driving voltage to effectively overcome the degradation of pixel unit. Therefore, the source driver of the disclosure can effectively reduce the amount of data transmission between the source drive and the timing controller, and can effectively reduce a large amount of algorithm in the timing controller, memory hardware space and compensation time.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A source driver for driving and sensing a display panel, comprising:

a driving circuit, coupled to a driving transistor of a pixel unit of the display panel through a first switch, and configured to output a reference signal through a driving channel according to a driving voltage data when the source driver is operated in a calibration mode;

a sensing circuit, coupled to an organic light-emitting diode of the pixel unit through a second switch, and configured to receive the reference signal through a sensing channel when the source driver is operated in the calibration mode, wherein the sensing channel is coupled to the driving channel through a third switch;

an analog-to-digital converter circuit, coupled to the sensing circuit, and configured to convert the reference signal to a digital reference signal; and a digital arithmetic circuit, coupled to the analog-to-digital converter circuit, and configured to obtain a calibration parameter according to the digital reference signal, wherein the source driver calibrates a sensing path for sensing the display panel according to the calibration parameter when the source driver is operated in a sensing mode, wherein the sensing path is a path between the sensing circuit and the analog-to-digital converter circuit inside the source driver, and the sensing path does not pass through the pixel unit, wherein the first switch and the second switch are turned off and the third switch is turned on when the source driver is operated in the calibration mode.

2. The source driver according to the claim 1, wherein the sensing path comprises at least one of the sensing circuit and the sensing channel.

3. The source driver according to the claim 1, wherein the reference signal is a fixed voltage.

4. The source driver according to the claim 1, wherein the driving circuit is further coupled to a timing controller, and the driving circuit receives the driving voltage data from the timing controller.

5. The source driver according to the claim 4, wherein the driving circuit comprises:

a voltage buffer, coupled to the sensing circuit by the driving channel; and a logic controller, coupled to the timing controller and the voltage buffer, and configured to receive the driving voltage data from the timing controller, and output the reference signal to the voltage buffer according to the driving voltage data, so that the voltage buffer outputs the reference signal to the sensing circuit through the driving channel.

6. The source driver according to the claim 1, wherein the digital arithmetic circuit is further configured to calculate a non-ideal parameter by comparing the digital reference signal and an ideal digital signal to generate the calibration parameter according to the non-ideal parameter.

7. The source driver according to the claim 6, wherein the non-ideal parameter comprises at least one of an offset error parameter, a gain error parameter or an integral nonlinearity parameter.

8. The source driver according to the claim 6, further comprising:

a register, coupled to the digital arithmetic circuit, and configured to store the non-ideal parameter.

9. The source driver according to the claim 1, wherein the display panel is an organic light emitting diode display panel.

10. A calibration method of a source driver for driving and sensing a display panel, comprising:

outputting, by a driving circuit, a reference signal through a driving channel according to a driving voltage data when the source driver is operated in a calibration mode, wherein the driving circuit is coupled to a driving transistor of a pixel unit through a first switch;

receiving, by a sensing circuit, the reference signal through a sensing channel when the source driver is operated in the calibration mode, wherein the sensing circuit is coupled to an organic light-emitting diode of the pixel unit through a second switch, and the sensing channel is coupled to the driving channel through a third switch;

converting, by an analog-to-digital converter circuit, the reference signal to a digital reference signal;

obtaining, by a digital arithmetic circuit, a calibration parameter according to the digital reference signal; and calibrating, by the source driver, a sensing path for sensing the display panel according to the calibration parameter when the source driver is operated in a sensing mode, wherein the sensing path is a path between the sensing circuit and the analog-to-digital converter circuit inside the source driver, and the sensing path does not pass through the pixel unit, wherein the first switch and the second switch are turned off and the third switch is turned on when the source driver is operated in the calibration mode.

11. The calibration method according to the claim 10, wherein the sensing path comprises at least one of the sensing circuit and the sensing channel.

12. The calibration method according to the claim 10, wherein the reference signal is a fixed voltage.

13. The calibration method according to the claim 10, wherein the driving circuit is further coupled to a timing controller, and the driving circuit receives the driving voltage data from the timing controller.

14. The calibration method according to the claim 13, wherein the step of outputting, by the driving circuit, the reference signal to the sensing circuit through the driving channel according to the driving voltage data comprises:

receiving, by a logic controller, the driving voltage data from the timing controller;

outputting, by the logic controller, the reference signal to a voltage buffer according to the driving voltage data; and outputting, by the voltage buffer, the reference signal to the sensing circuit through the driving channel.

15. The calibration method according to the claim 10, wherein the step of obtaining, by the digital arithmetic circuit, the calibration parameter according to the digital reference signal comprises:

calculating, by the digital arithmetic circuit, a non-ideal parameter by comparing the digital reference signal and an ideal digital signal; and generating, by the digital arithmetic circuit, the calibration parameter according to the non-ideal parameter.

16. The calibration method according to the claim 15, wherein the non-ideal parameter comprises at least one of an offset error parameter, a gain error parameter or an integral nonlinearity parameter.

17. The calibration method according to the claim 15, further comprising:

storing, by a register, the non-ideal parameter.

18. The calibration method according to the claim 10, wherein the display panel is an organic light emitting diode display panel.

* * * * *